US006457206B1

(12) United States Patent
Judson

(10) Patent No.: US 6,457,206 B1
(45) Date of Patent: Oct. 1, 2002

(54) REMOTE-CONTROLLED VACUUM CLEANER

(76) Inventor: Scott H. Judson, 4 Spray Ave., Marblehead, MA (US) 01945

( * ) Notice: Subject to any disclaimer, the term of this patent is extended or adjusted under 35 U.S.C. 154(b) by 0 days.

(21) Appl. No.: 09/694,082

(22) Filed: Oct. 20, 2000

(51) Int. Cl.[7] ..... A47L 9/00
(52) U.S. Cl. ..... 15/320; 15/339; 15/340.1
(58) Field of Search ..... 15/320, 339, 340.1

(56) References Cited

U.S. PATENT DOCUMENTS

| | | | | |
|---|---|---|---|---|
| 4,306,329 A | * | 12/1981 | Yokoi | 15/340.1 X |
| 4,369,543 A | | 1/1983 | Chen et al. | |
| 4,513,469 A | * | 4/1985 | Godfrey et al. | 15/340.2 X |
| 4,854,000 A | * | 8/1989 | Takimoto | 15/340.1 X |
| 5,548,511 A | * | 8/1996 | Bancroft | 15/340.1 X |
| 5,613,261 A | * | 3/1997 | Kawakami et al. | 15/340.1 X |
| 5,634,237 A | * | 6/1997 | Paranjpe | 15/340.1 X |
| 5,709,007 A | * | 1/1998 | Chiang | 15/340.1 X |
| 5,815,880 A | * | 10/1998 | Nakanishi | 15/340.1 X |
| 5,841,259 A | * | 11/1998 | Kim et al. | 15/340.1 X |
| 5,926,909 A | | 7/1999 | McGee | |
| 5,940,930 A | | 8/1999 | Oh et al. | |

* cited by examiner

*Primary Examiner*—Chris K. Moore
(74) *Attorney, Agent, or Firm*—David H. Judson

(57) ABSTRACT

A remote-controlled vacuum cleaner comprises a vacuum cleaner vehicle designed to be positioned and moved in any direction relative to a surface (e.g., a carpet) to be cleaned, and a handheld remote control device including a control element (e.g., a joystick, a roller ball, or the like) and a transmitter for sending control signals to electronic motor drive circuits in the vehicle. According to the invention, the handheld remote control device preferably is controlled by a processor and includes a display (e.g., a video monitor) for displaying images from one or more cameras located on or within the vacuum cleaner vehicle. The vacuum cleaner vehicle preferably includes a misting device in which cleaning solution is stored. The misting device includes a nozzle for misting the cleaning solution onto the surface to be cleaned, preferably prior to the vacuuming operation. The vacuum cleaner vehicle preferably also includes a dryer mechanism (e.g., a blower, an electric resistive heater, or the like) for heating the surface to be vacuumed to enhance the cleaning operation and/or to remove any excess cleaning solution. The vacuum cleaner vehicle may also be foldable to reduce its size for storage.

9 Claims, 2 Drawing Sheets

REMOTE-CONTROLLED VACUUM CLEANER

BACKGROUND OF THE INVENTION

1. Technical Field

The present invention relates generally to vacuum cleaners and, in particular, to a remote-controlled vacuum cleaner that includes a cleaning solution mister, and a carpet dryer.

2. Brief Description of the Related Art

Remote-controlled vacuum cleaners are well-known in the prior art. Representative patents include U.S. Pat. No. 4,369,543 to Chen et al., U.S. Pat. No. 5,926,909 to McGee, and U.S. Pat. No. 5,940,930 to Oh et al. Chen et al., for example, describes a system comprising a remote control device having radio transmitting circuits matched with a control mechanism for generating various control signals, and a separate vacuum cleaner disposed with vacuum cleaning fittings for dust suction operations, a storage battery system for supplying the required power in the vacuum cleaner, a radio receiving circuit, and electric motors arranged in conjunction with the radio receiving circuit for moving the vacuum cleaner under the control of the remote control device. McGee illustrates a similar type of apparatus, but it also includes a separate recharge housing unit that is cooperable with a handheld remote controller and a vacuum cleaner vehicle for simultaneously charging batteries in the remote controller as well as the vehicle.

While remote control vacuum cleaners such as described above are advantageous, there remains a need in the art to provide improvements to such devices. The present invention addresses this need.

BRIEF SUMMARY OF THE INVENTION

A remote-controlled vacuum cleaner comprises a vacuum cleaner vehicle designed to be positioned and moved in any direction relative to a surface (e.g., a carpet) to be cleaned, and a handheld remote control device including a control element (e.g., a joystick, a roller ball, or the like) and a transmitter for sending control signals to electronic motor drive circuits in the vehicle. According to the invention, the handheld remote control device preferably is controlled by a processor and includes a display (e.g., a video monitor) for displaying images from one or more cameras located on or within the vacuum cleaner vehicle. The vacuum cleaner vehicle preferably includes a misting device in which cleaning solution is stored. The misting device includes a nozzle for misting the cleaning solution onto the surface to be cleaned, preferably prior to the vacuuming operation. The vacuum cleaner vehicle preferably also includes a dryer mechanism (e.g., a blower, an electric resistive heater, or the like) for heating the surface to be vacuumed to enhance the cleaning operation and/or to remove any excess cleaning solution. The vacuum cleaner vehicle may also be foldable to reduce its size for storage.

BRIEF DESCRIPTION OF THE DRAWINGS

For a more complete description of the present invention, reference is now made to the following Detailed Description in conjunction with the accompanying Drawings in which.

DETAILED DESCRIPTION OF THE PREFERRED EMBODIMENT

Figure 1:
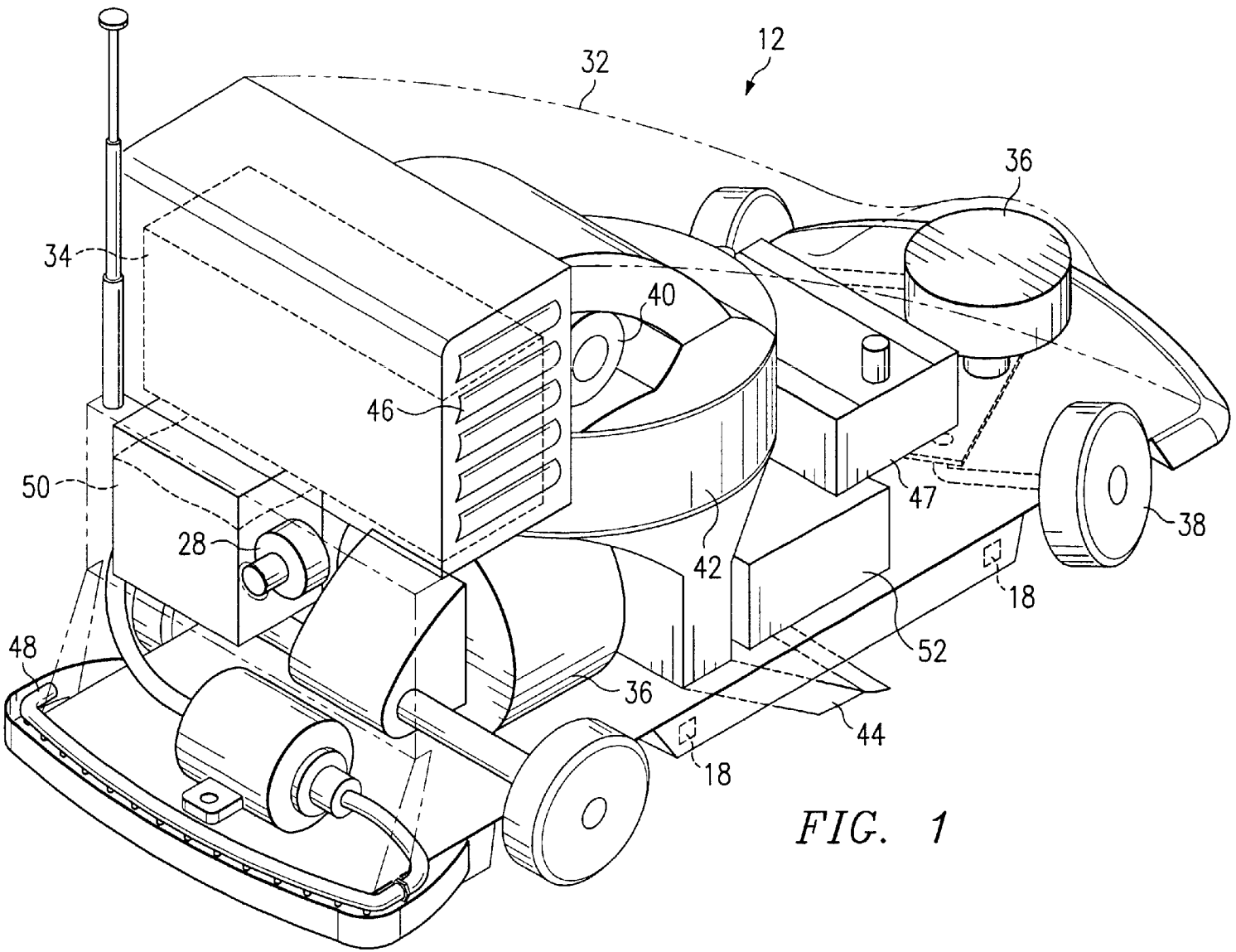
FIG. 1 is a perspective view of the inventive remote-controlled vacuum cleaner.
Figure 2:
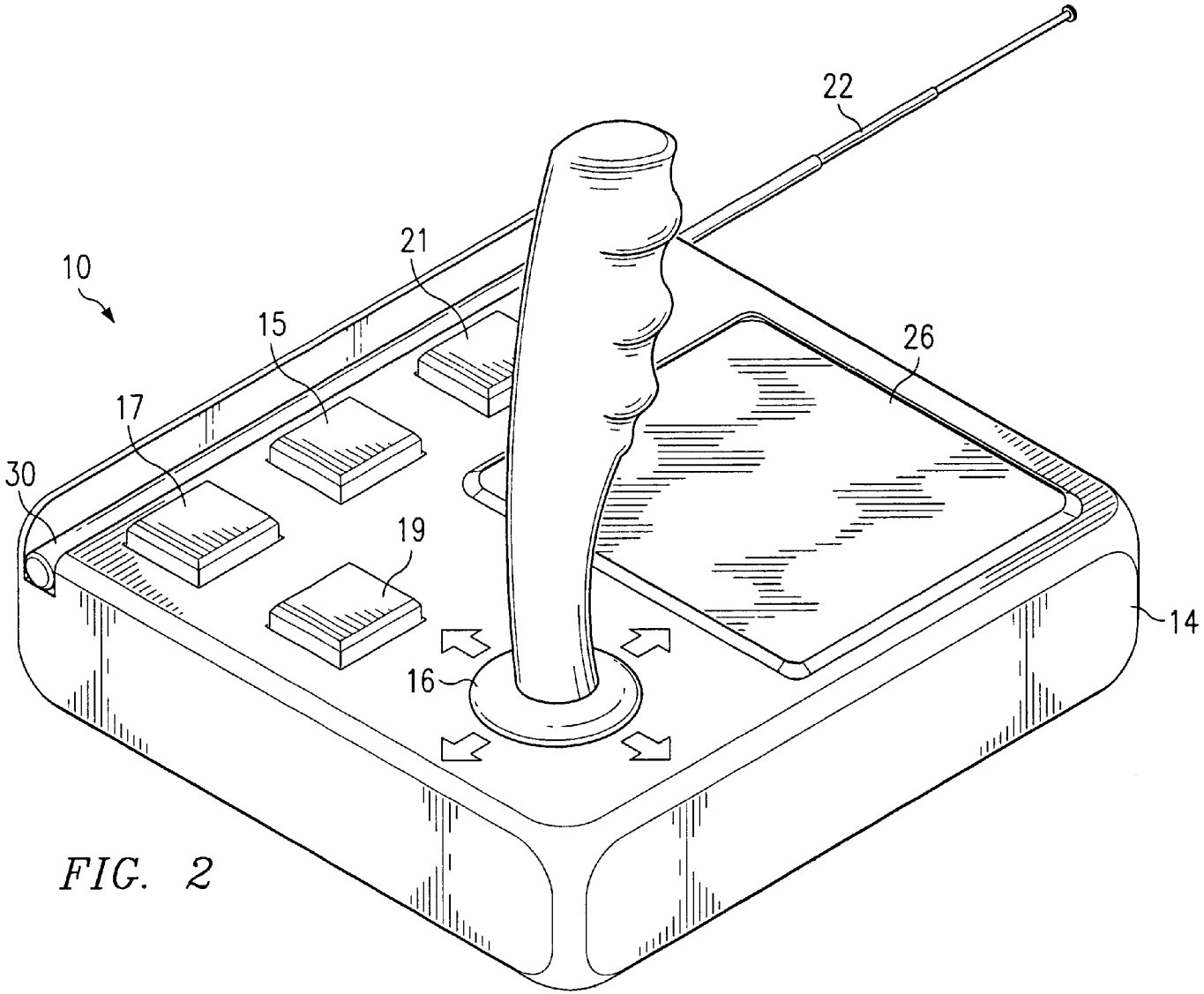
FIG. 2 is a perspective view of the remote controller unit.

Referring now to the drawings, the inventive vacuum cleaner comprises two primary components: a remote controller 10, and a vacuum cleaner vehicle 12. The remote controller 10 preferably is a handheld device that comprises a housing 14 that supports control electronics and a set of batteries. The remote controller 10 is adapted to be grasped by the user to send control signals remotely to direct the movement of the vacuum cleaner vehicle 12 or the cleaning of rugs, floors and other surfaces. The remote controller 10 includes a first switch 15 that, upon activation, enables the user to control the vehicle manually through a joystick 16 or other control actuator. Activation of a second switch 17 enables the remote controller in an "automatic" or programmed mode of operation to perform the vacuum cleaning operation without direct intervention by a user (i.e., through use of the actuator 16). In the automatic mode, a preprogrammed set of movements for the vehicle is carried out using a set of or more sensors 18 on the vehicle to locate the carpet edge. As will be explained in more detailed below, when the sensors locate the edge, the vehicle is braked and rotated into a different position to continue the cleaning operation. Thus, in the automatic mode, the vacuum cleaner vehicle is controlled through a program in the remote controller 10, together with the sensors 18 that track the location and movement of the vehicle relative to the carpet. The remote controller 10 also includes a third button 19 to start the vacuum operation either manually or automatically. The controller 10 also includes an antenna 22 to transmit the control signals to a receiver in the vehicle. A fourth button 21 stops the vehicle.

As also seen in FIG. 1, the remote controller 10 also includes a display 26 (e.g., a liquid crystal display (LCD)) for displaying images provided to the device from one or more cameras 28 on or in the vehicle. The cameras provide images to the user. A pen stylus 30 is stored oil the outside of the controller and can be removed and used to select the various choices of the buttons. A removable protective cover (not shown) may be used to protect the display. The cover preferably fits over the entire remote controller and may include an opening for the joystick.

The vacuum cleaner vehicle 12 comprises a housing 32, having a removable canister 34 (or similar type of container), for emptying debris, motor or motors 36 for movement of wheels 38. A vacuum motor 40 communicates with a fan or impeller 42 to produce a vacuum that draws debris into the nozzle 44 and thus into canister 34. The canister 34 may be removed from the housing 32 for the emptying of the debris that is sucked Lip by the vacuum. Air exits the housing through a side aperture covered by a plurality of fins 46. Batteries 47, which may be rechargeable, provide a power source.

The vacuum cleaner vehicle may also include a mister 48 having a cleaning solution 50. The cleaning solution may be a commercial off-the-shelf product (e.g., Resolve cleaner). As the vacuum cleaner is moved, the mister 48 sprays a line mist of the cleaning solution onto the surface. If desired, the mister can be used to spray a fine mist of air freshener to remove any odor of the debris. Or, the mister 48 may be used to provide a fine mist of water to simply hydrate the surface to facilitate loosening of the debris. The vehicle may also include a dryer (e.g., a resistive heater or blower) 52 for helping to dry the solution as the vacuum cleaner is used.

If desired, the remote controller may include a processor that may be programmed (e.g., with a suitable control program) to effect control operations. Thus, e.g., a program may respond to given inputs (e.g., from the sensors) to brake the vacuum cleaner (e.g., by removing power to the motor that drives the wheels). The control program may be stored in permanent memory and then transferred to a random access memory (RAM) when required. The remote controller may also include a suitable operating system. As an alternative to the processor and the control program, the device may utilize a programmable logic control (PLC) or other suitable control electronics.

According to another feature of the invention, the control program in the remote controller may provide a set of controlled movements to the vacuum cleaner vehicle. Thus, for example, the user may program the device for a carpet of a certain size and then position the remote controlled vacuum cleaner vehicle at one corner thereof. Upon activation, the vehicle then moves along the carpet according to the programmed plan. When it reaches the end of a forward movement for a given distance (e.g., the length of the carpet), he vehicle is automatically braked, moved laterally, and the rotated 180 degrees so that it faces an opposite direction. It is then moved forward again to continue the vacuuming operation. As the vehicle moves forward, the mister may be actuated to spray the cleaning solution, or the dryer activated to dry the surface. In one particular embodiment, the mister is located on the back of the vehicle so that, as the vehicle moves forward along one path, the mister applies the cleaning solution to an adjacent path. When the vehicle then returns along the adjacent path, the cleaning solution will have be pre-applied. In like manner, the dryer may be used to dry the cleaning solution from an adjacent, previously-vacuumed path.

What is claimed is:

1. Apparatus, comprising:

a remote controller; and a vacuum cleaner vehicle, the vehicle including a misting device for spraying a given fluid on a given first portion of a surface as the vacuum cleaner vehicle is controlled, by the remote controller, to vacuum a given second portion of the surface;

wherein the given first portion of the surface receives an application of the given fluid prior to vacuuming of the given first portion;

wherein the vehicle further includes a drying device for drying the given fluid after the given second portion of the surface has been vacuumed.

2. The apparatus as described in claim 1 wherein the vacuum cleaner vehicle includes at least one sensor for locating an edge of the surface.

3. The apparatus as described in claim 1 wherein the given fluid is a carpet cleaning solution.

4. The apparatus as described in claim 1 wherein the given fluid is an air freshener.

5. The apparatus as described in claim 1 wherein the given fluid is water.

6. The apparatus as described in claim 1 wherein the vehicle includes at least one camera and the remote controller includes a display to display images provided to the remote controller from the camera.

7. Apparatus, comprising:

a remote controller, and a vacuum cleaner vehicle including:

a misting device for spraying a given fluid on a surface;

a drying device for drying the given fluid; and a vacuum device for suctioning debris from the surface;

wherein the vehicle is controlled by the remote controller selectively in one of a manual and autonomous mode (a) to move the vehicle along a given path; (b) to spray the given fluid on the surface using the misting device as the vehicle is in motion; (c) to suction debris from the surface using the vacuum device as the vehicle is in motion, and (d) to dry the given fluid from the surface using the drying device.

8. The apparalus as described in claim 7 wherein the vacuum cleaner vehicle includes at least one sensor.

9. The apparatus as described in claim 8, wherein the sensor determines if the vehicle is approaching an edge of the surface.

* * * * *